United States Patent [19]

Shoji

[11] Patent Number: 4,843,303

[45] Date of Patent: Jun. 27, 1989

[54] VOLTAGE REGULATOR CIRCUIT

[75] Inventor: Norio Shoji, Kanagawa, Japan

[73] Assignee: Sony Corporation, Tokyo, Japan

[21] Appl. No.: 216,148

[22] Filed: Jul. 7, 1988

[30] Foreign Application Priority Data

Jul. 16, 1987 [JP] Japan ..... 62-178026

[51] Int. Cl.[4] ..... G05F 3/22

[52] U.S. Cl. ..... 323/313; 323/314

[58] Field of Search ..... 323/311, 312, 313, 314, 323/315, 316

[56] References Cited

U.S. PATENT DOCUMENTS 3,320,439 5/1967 Widlar .
3,566,289 2/1971 Cope .
3,617,859 11/1971 Dobkin .
4,061,959 12/1977 Ahmed ..... 323/313
4,118,712 10/1978 Kawasaki ..... 323/313
4,644,257 2/1987 Bohme et al. ..... 323/313

*Primary Examiner*—Peter S. Wong
*Attorney, Agent, or Firm*—Lewis H. Eslinger; Jay H. Maioli; Donald S. Dowden

[57] ABSTRACT

A voltage regulator circuit arranged such that a constant current source through which a current of an integral multiple of a current from a reference current source is connected to a collector-emitter path of a transistor in series so that it is possible to suppress a base-emitter voltage of the transistor from being fluctated due to the scattering of the base impurity concentration in the transistor during the manufacturing process.

10 Claims, 3 Drawing Sheets

Vcc
1
3
βI2
VBE
42
43
I2
44
45
46
KoVT
39
38
30A
32
31
34
37
I35
N
36
35N
33
I33

Vo
Vcc
1
3
I2
24
23
22
VBE
βI2
KoVT
28
I1
21

VOLTAGE REGULATOR CIRCUIT

BACKGROUND OF THE INVENTION

1. Field of the Invention

The present invention relates generally to voltage regulator circuits and more particularly to a voltage regulator circuit which can suppress fluctuations of its output voltage.

2. Description of the Prior Art

Japanese Published Patent Gazette No. 53-18694 (corresponding to Japanese Laid-Open Patent Application Gazette No. 46-3527) or the like discloses a voltage regulator circuit in which a reference voltage is set to be equal to an energy gap voltage (1.205 V) of silicon so as to reduce a temperature coefficient to zero. FIG. 1 illustrates an example of such a conventional voltage regulator circuit. This conventional voltage regulator circuit will be described hereinafter with reference to FIG. 1.

As FIG. 1 shows, there is provided a transistor 11 of which the collector and base are both connected to a base of a transistor 12. The collector of the transistor 12 is connected to a base of a transistor 13. The emitters of both the transistors 11 and 13 are directly grounded and the emitter of the transistor 12 is grounded through a resistor 14. The collector of the transistor 13 is commonly connected to a current source 15 and a base of a buffer transistor 16. The emitter of the transistor 16 and the collectors of the transistors 11 and 12 are connected together through resistors 17 and 18. The current source 15 and the collector of the transistor 16 are both connected to a voltage source terminal 1 (Vcc). An output terminal 2 is led out from the emitter of the transistor 16.

As is well known, between a base-emitter voltage $V_{BE}$ and a collector current Ic of a transistor, there is established a relationship expressed by the following equation (1) or (2).

$$Ic = Is \cdot \exp\left(\frac{q}{kT} \cdot V_{BE}\right) \tag{1}$$

$$\begin{aligned} V_{BE} &= \frac{kT}{q} \cdot \ln\left(\frac{I_{C2}}{I_S}\right) \\ &= V_T \ln\left(\frac{I_C}{I_S}\right) \end{aligned} \tag{2}$$

where Is is the saturation current, q the electron charge, T the absolute temperature and k the Boltzman's constant.

In the known voltage regulator circuit shown in FIG. 1, $I_{C1}$ and $I_{C2}$ represent collector currents of the transistors 11 and 12, $V_{BE1}$ and $V_{BE2}$ represent base-emitter voltages thereof and $R_{14}$ represents a resistance value of the resistor 14. Then, the following equation (3) is established.

$$V_{BE1} = V_{BE2} + I_{C2}R_{14} \tag{3}$$

Applying the equation (2) to the equation (3) yields the following equations (4a) and (4b)

$$V_T \ln\left(\frac{I_C}{I_S}\right) = V_T \ln\left(\frac{I_{C2}}{I_S}\right) + I_{C2}R_{14} \tag{4a}$$

$$I_{C2} = \frac{V_T}{R_{14}} \ln\left(\frac{I_{C1}}{I_{C2}}\right) \tag{4b}$$

If a base-emitter voltage of the transistor 13 is taken as $V_{BE3}$ and a resistance value of the resistor 18 is taken as $R_{18}$, the reference voltage $V_{REF}$ developed at the output terminal 2 is expressed as in the following equation (5) by utilizing the equation (4b).

$$\begin{aligned} V_{REF} &= I_{C2} \cdot R_{18} + V_{BE3} \\ &= \frac{R_{18}}{R_{14}} V_T \ln\left(\frac{I_{C1}}{I_{C2}}\right) + V_{BE3} \\ &= K \cdot V_T + V_{BE3} \end{aligned} \tag{5}$$

$$K \equiv \frac{R_{18}}{R_{14}} \cdot \ln\left(\frac{I_{C1}}{I_{C2}}\right)$$

From the foregoing equation (2), it is thus apparent that $V_T$ (thermal voltage) has a positive temperature coefficient of about 1/300. Meanwhile, the base-emitter voltage $V_{BE3}$ of the transistor 13 is fluctuated in the negative direction with a ratio of about −2 mV/°C. In the voltage regulator circuit shown in FIG. 1, by properly selecting the resistance value of the resistor 18, it is possible to balance the base-emitter voltage of negative temperature coefficient of the transistor 13 and the voltage of positive temperature coefficient produced across the resistor 18 due to the collector current of the transistor 12. Thus, as described above, it is possible to obtain the reference voltage $V_{REF}$ of zero temperature coefficient equal to the energy-gap voltage of the silicon. If a voltage across the resistor 18 at that time is taken as $K_0 \cdot V_T$, $V_T$ is nearly equal to 26 mV ($V_t \approx 26$ mV) so that $K_0$ becomes substantially equal to 23 ($K_0 \approx 23$).

A voltage regulator circuit mounted on the integrated circuit (IC) is required to have small fluctuation of the output voltage, in addition to the excellent temperature characteristic.

As will be clear from the equation (5), the output voltage from the conventional voltage regulator circuit shown in FIG. 1 depends on the base-emitter voltage $V_{BE}$ of the transistor 13. This base-emitter voltage $V_{BE}$ is dependent on the saturation current $I_S$ of the transistor 13 as will be apparent from the equation (2).

In the manufacturing process of the integrated circuit, however, if impurity concentration in the base of a transistor is fluctuated upward or downward, the saturation current Is is decreased or increased dependent on this fluctuation, while on the contrary the base-emitter voltage $V_{BE}$ is increased or decreased.

As earlier noted, when the output constant voltage from the voltage regulator circuit is set to be $V_{REF} = 1.205$ V, the fluctuation of the base-emitter voltage $V_{BE}$ in the general manufacturing process reaches, for example, about ±40 mV, i.e., about ±3.3%. For this reason, in order to control the output voltage to fall in a predetermined range, the administration of the manufacturing process must be made more strict and the trimming of the resistor or the like must be carried out.

OBJECTS AND SUMMARY OF THE INVENTION

It is an object of this invention to provide an improved voltage regulator circuit.

It is another object of the present invention to provide a voltage regulator circuit in which a constant current source through which a current of which the magnitude is an integral multiple of a reference current flows is connected to a collector-emitter path of a transistor in cascade to generate a base-emitter voltage of a transistor from the base of the transistor.

It is a further object of the present invention to provide a voltage regulator circuit which can suppress a base-emitter voltage from being fluctuated due to a fluctuation of a base impurity concentration in the manufacturing process.

It is yet a further object of the present invention to provide a voltage regulator circuit having an excellent temperature characteristic.

According to an aspect of the present invention, there is provided a voltage regulator circuit comprising:

(a) a transistor having an input terminal and first and second output terminals; and (b) a current source for multiplying a predetermined current by a predetermined factor, said current source being connected to said first and second output terminals of said transistor in series, wherein a predetermined voltage is derived from said input terminal.

According to other aspect of the present invention, there is provided a voltage regulator circuit comprising:

(a) a first current source for generating a predetermined current;

(b) a first transistor supplied at its base with the predetermined current from said first current source and for generating an emitter current which is $\beta$ times as large as said predetermined current;

(c) a second transistor having a collector connected with said emitter of said first transistor and of which the emitter is grounded;

(d) a second current source connected at its one end to the base of said second transistor and one end of a resistor which generates a reference voltage; and (e) a buffer amplifier connected between the emitter of said first transistor and the other end of said resistor, wherein a predetermined voltage is derived at the other end of said resistor.

According to a further aspect of the present invention, there is provided a voltage regulator circuit comprising:

(a) a first current source for generating a predetermined current;

(b) an emitter-grounded first transistor supplied at its base with the predetermined current from said first current source;

(c) a second transistor having a collector connected to a first reference potential, a base connected through a resistor to said first reference potential and an emitter connected to the collector of said first transistor and a voltage output terminal; and (d) a second current source connected between the base of said second transistor and a second reference potential.

According to yet a further aspect of the present invention, there is provided a constant current circuit comprising:

(a) a first transistor of a first conductivity type having an emitter connected through a first resistor to a first reference potential;

(b) a second transistor of the first conductivity type having a base and a collector connected to the base of said first transistor and an emitter connected through a second resistor to said first reference potenial;

(c) a third transistor of a second conductivity type having a base connected to the collector of said first transistor and a collector of a fourth transistor of a second conductivity type of which the emitter is grounded, a collector connected to the base and collector of said second transistor and an emitter connected to a base of said fourth transistor; and (d) a fifth transistor of a second conductivity type having a base connected to the base of said fourth transistor and the emitter of said third transistor, a collector connected through a third resistor to the emitter of said third transistor and an emitter connected through a fourth resistor to a second reference potential, wherein an output voltage is derived from the emitter of said second transistor and/or the collector of said fifth transistor.

The above and other objects, features and advantages of the present invention will become apparent from the following detailed description of the preferred embodiments to be taken in conjunction with the accompanying drawings, in which like reference numerals identify like elements and parts.

DETAILED DESCRIPTION OF THE PREFERRED EMBODIMENTS

Figure 2:
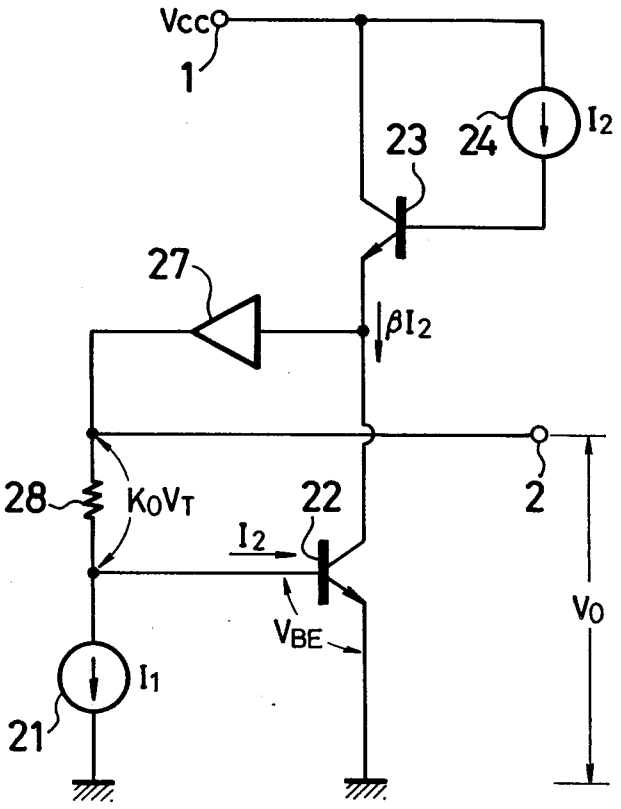
FIG. 2 is a connection diagram showing a fundamental arrangement of an embodiment of a voltage regulator circuit according to the present invention.
Figure 1:
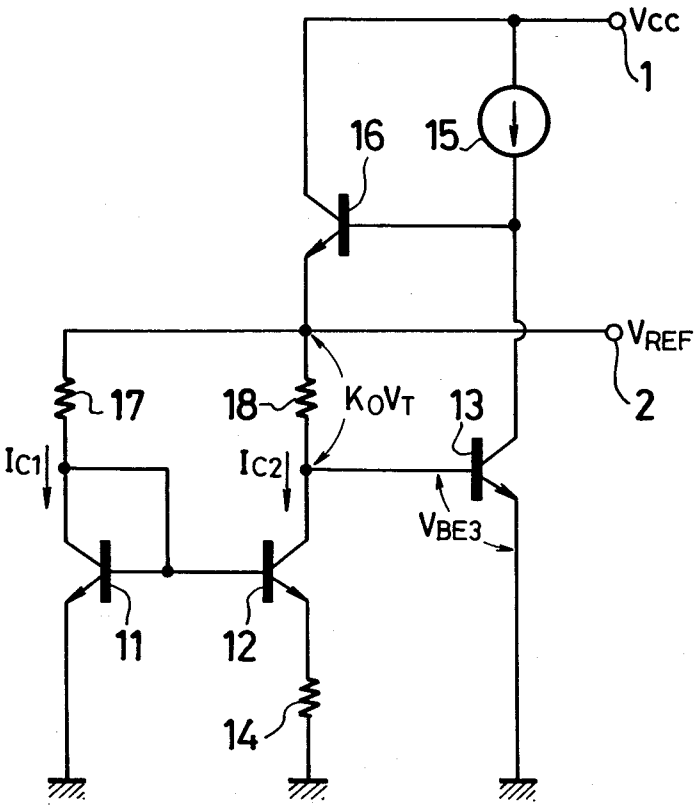
FIG. 1 (PRIOR ART)
FIG. 1 is a diagram showing an example of an arrangement of a conventional voltage regulator circuit.

An embodiment of a voltage regulator circuit according to the present invention will now be described with reference to FIGS. 2 to 5. Throughout the following embodiments of the present invention, respective transistors are each a bi-polar transistor. FIG. 2 illustrates a fundamental arrangement of the one embodiment of the present invention.

As FIG. 2 shows, one end of a current source 21 is connected to a base of a transistor 22, and the other end of the current source 21 and the emitter of the transistor 22 are grounded. The collector of the transistor 22 is connected to an emitter of a second transistor 23, and the base of the transistor 23 is connected to one end of a second current source 24. The collector of the transistor 23 and the other end of the second current source 24 are connected together to the voltage source 1 (Vcc). The junction between the collector of the transistor 22 and the emitter of the transistor 23 is connected to an input terminal of a buffer 27. The output terminal of the buffer 27 is directly connected to an output terminal 2 and is also connected commonly through a resistor 28 to the current source 21 and the base of the transistor 22.

The operation of the embodiment shown in FIG. 2 is as follows.

$I_1$ and $I_2$ represent currents that flow through the first and second current sources 21 and 24, respectively. Also, $\beta(>>1)$ represents a current amplification factor of each of the transistors 22 and 23. Then, the current $I_2$ flows to the base of the transistor 23 so that the collector current of the transistor 23 becomes $\beta I_2$ and that the collector current of the transistor 22 connected to the transistor 23 in series also becomes $\beta I_2$. To the base of the transistor 22, there flows a current which is $1/\beta$ of the collector current, i.e. the current $I_2$ from the buffer 27 through the resistor 28. Accordingly, due to the constant current $I_1$ and the base current $I_2$ of the transistor 22, the voltage across the resistor 28 is presented as $(I_1+I_2)\ R_{28}$ where $R_{28}$ is the resistance value of the resistor 28.

In order that the output voltage $V_0$ derived from the terminal 2 becomes equal to the afore-mentioned energy-gap voltage $V_{REF}$ in FIG. 2, the following relationship has to be established.

$$(I_1+I_2)\ R_{28}=K_0\ V_T$$

The currents $I_1$ and $I_2$ of the respective current sources 21 and 24 are expressed by the following equation (6) where $$K_o = K_1 + K_2 \qquad \left.\begin{aligned} I_1 &= K_1\ V_T/R_{28} \\ I_2 &= K_2\ V_T/R_{28} \end{aligned}\right\} \qquad (6)$$

A method for determining the coefficients $K_1$ and $K_2$ will be described with reference to an example of a practical arrangement shown in FIG. 3.

The output voltage $V_0$ thus produced at the terminal 2 is expressed by the following equation (7).

$$V_0=V_{REF}=K_0V_T+V_{BE}(\beta I_2) \qquad (7)$$

Although the base-emitter voltage $V_{BE}$ of the transistor 22 depends on the saturation current $I_S$ as will be clear from the equation (2), if a ratio between the current amplification factor $\beta$ and the saturation current $I_S$ is taken as A, since the correlation between the current amplification factor $\beta$ and the saturation current $I_S$ is approximately 1, $A=\beta/I_S$ becomes a constant value regardless of the fluctuation of the base impurity concentration.

Thus, the equation (2) yields $$V_{BE}=V_T \ln (A\ I_2) \qquad (8)$$

Therefore, the base-emitter voltage $V_{BE}$ of the transistor 22 depends on a base current which is equal to the current $I_2$ of the second current source 24. As will be clear from the equation (6), although this current $I_2$ fluctuates in response to the fluctuation of the resistance value $R_{28}$ of the resistor 28, the fluctuation of the resistance value $R_{28}$ is so small that it is negligible as compared with the fluctuation of the saturation current $I_S$ so that according to this embodiment, the fluctuation of the base-emitter voltage $V_{BE}$ of the transistor 22, and hence the fluctuation of the output voltage $V_0$ at the terminal 2 can be suppressed.

The practical arrangement of the embodiment shown in FIG. 2 will be described with reference to FIG. 3.

Figure 3:
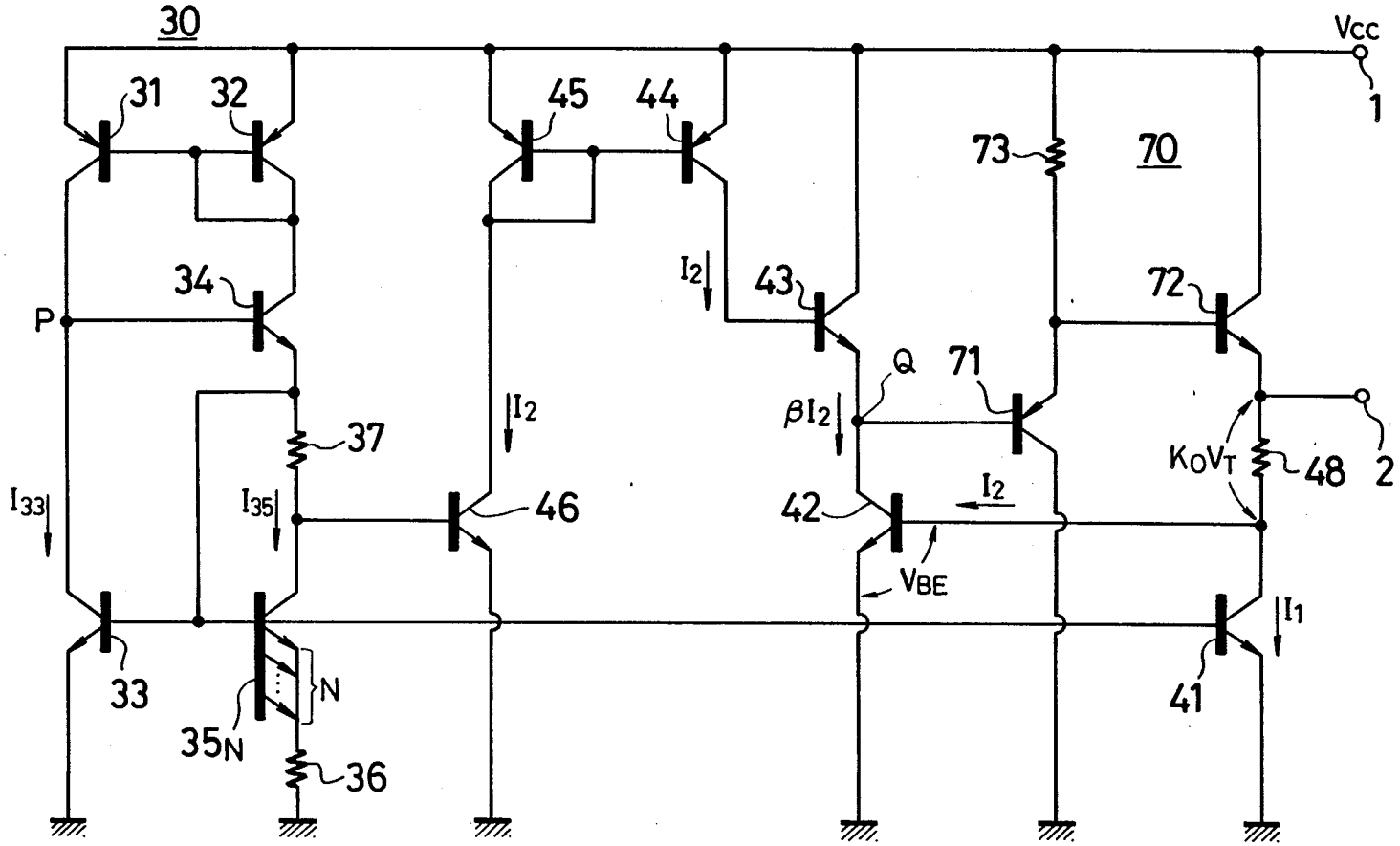
FIG. 3 is a connection diagram showing a practical arrangement of the embodiment of the present invention shown in FIG. 2.

In FIG. 3, reference numeral 30 generally designates a constant current circuit. In the constant current circuit 30, as shown in FIG. 3, emitters of a pair of PNP transistors 31 and 32 are both connected to a voltage source terminal 1 (Vcc), and the bases thereof are coupled to each other. The collector of the transistor 32 is connected to the base thereof, thus a so-called current mirror circuit configuration being established. The collector of the PNP transistor 31 and a collector of an NPN transistor 33 of which the emitter is grounded are coupled together and a collector of an NPN transistor 34 whose base is connected to the above junction P is connected to the collector of the PNP transistor 32.

A transistor $35_N$ is what might be called an NPN multi-emitter transistor in which the emitter thereof has an area N times as large as that of the transistor 33. In other words, the multi-emitter transistor $35_N$ has a current capacity N times as large as that of the transistor 33. The multi-emitters of the transistor $35_N$ are commonly connected and then grounded through a resistor 36. The collector of the transistor $35_N$ is connected to the emitter of the transistor 34 through a load resistor 37, while the base of the transistor $35_N$ is commonly connected to the base of the transistor 33 ad the emitter of the transistor 34.

A base of a transistor 41 is commonly connected to the bases of the transistors 33 and $35_N$ in the constant current circuit 30. The collector of the transistor 41 is connected to a base of a transistor 42 and the emitters of both the transistors 41 and 42 are grounded. The collector of the transistor 42 and an emitter of a transistor 43 are connected to each other and the collector of the transistor 43 is connected to the voltage source terminal 1.

Emitters of a pair of PNP transistors 44 and 45 are connected to the voltage source terminal 1, the bases thereof are connected to each other and the collector of the transistor 45 is connected to the base thereof, thus forming a current mirror circuit configuration. The collector of the PNP transistor 44 and the base of the NPN transistor 43 are connected together. A collector of an NPN transistor 46 with its emitter grounded is connected to the collector of the PNP transistor 45. The base of the transistor 46 is connected to the collector of the multi-emitter transistor $35_N$ in the constant current circuit 30.

To a junction Q between the collector of the transistor 42 and the emitter of the transistor 43, there is connected a base of a PNP transistor 71 in a buffer 70. The emitter of the transistor 71 is directly connected to a base of an NPN transistor 72 and is also connected through a resistor 73 to the voltage source terminal 1. The collector of the transistor 71 is grounded. The collector of the transistor 72 is connected to the voltage source terminal 1 and the emitter thereof is directly connected to the output terminal 2 and is also connected through a resistor 48 to the collector of the transistor 41.

The transistors 41 and 44 in FIG. 3 correspond to the current sources 21 and 24 in FIG. 2, respectively.

A current $I_{35}$ supplied to the multi-emitter transistor $35_N$ is equally divided to each of unit transistors which are presented as N emitters in FIG. 3. Thus, in the constant current circuit 30 shown in FIG. 3, if respective base-emitter voltages of the transistors 33 and $35_N$ are taken into consideration, the following equation (9) is established similarly to the equation (4b).

$$I_{35} = \frac{V_T}{R_{36}} \ln\left(\frac{N \cdot I_{33}}{I_{35}}\right) \tag{9}$$

The PNP transistors 31 and 32 of current mirror circuit configuration can keep the collector currents $I_{33}$ and $I_{35}$ of the transistors 33 and $35_N$ in a relationship expressed as $I_{33}=I_{35}$. The application of this relationship to the equation (9) yields the following equation (10)

$$I_{35} = \frac{V_T}{R_{36}} \ln N \tag{10}$$

Since the bases of the transistors 33, $35_N$ and 41 are connected to one another, the respective collector currents thereof are kept equal to one another in magnitude so that the constant current $I_1$ equal to the current $I_{35}$ expressed by the equation (10) flows into the transistor 41.

In FIG. 3, if the respective base-emitter voltages of the transistors 33 and 46 are taken into consideration, the following equation (11) is established where $R_{37}$ is the resistance value of the load resistor 37.

$$V_T \ln\left(\frac{I_{33}}{I_S}\right) = V_T \ln\left(\frac{I_2}{I_S}\right) + I_{35} R_{37} \tag{11}$$

Rearranging the equation (11) yields the following equation (12)

$$\frac{I_{33}}{I_2} = \exp\left(\frac{I_{35} R_{37}}{V_T}\right) \tag{12}$$

Since the collector current $I_{35}$ of the multi-emitter transistor $35_N$ is obtained as in the equation (10), to substitute the equation (10) to the equation (12) and rearranging the same yield the following equation (13)

$$\frac{I_{33}}{I_2} = \exp\left(\frac{R_{37}}{R_{36}}\right) = N^m$$

where $$m = R_{37}/R_{36} \tag{13}$$

$$\therefore I_2 = I_{33}/N^m$$

where $m=R_{37}/R_{36}$

While the constant current $I_2$ expressed by the equation (13) flows into the transistor 46, the transistors 45 and 44 of the current mirror circuit configuration cause a current of which the magnitude is the same as that of the constant current $I_2$ expressed by the equation (13) to flowed into the base of the transistor 43. Thus, similarly to the embodiment shown in FIG. 2, the current $\beta I_2$ from the transistor 43 is supplied to the collector of the transistor 42 and the transistor 72 in the buffer 70 supplies the current $I_2$ through the resistor 48 to the base of the transistor 42.

Through the resistor 48 there flows the collector current $I_1$ of the transistor 41 and the base current $I_2$ of the transistor 42. In the embodiment shown in FIG. 3, in order to derive the energy-gap voltage $V_{REF}$ from the output terminal 2, from the equations (6), (10) and (13), the coefficients $K_1$ and $K_2$ must be defined as expressed by the following equation (14)

$$\left.\begin{aligned} K_1 &= \ln N \\ K_2 &= \frac{\ln N}{N^m} \end{aligned}\right\} \tag{14}$$

where $m=R_{37}/R_{36}$.

In this embodiment, when the emitter area ratio of the multi-emitter transistor $35_N$ is selected so as to satisfy $N=8$, the resistance values of the emitter resistor 36 and the resistors 37 and 48 are determined as, for example $R_{36}=1.2K\Omega$, $R_{37}=2.4K\Omega$ and $R_{48}=12K\Omega$, respectively.

In this case, it should be noted that from the equation (13), the equality, $I_2=I_1/8^2$ be established. In this embodiment, since there is provided a very small constant current output, the resistance value of the resistor can be selected to be relatively low. Thus, it is possible to employ the constant current circuit 30 which is suitably fabricated into an integrated circuit (IC).

Figure 4:
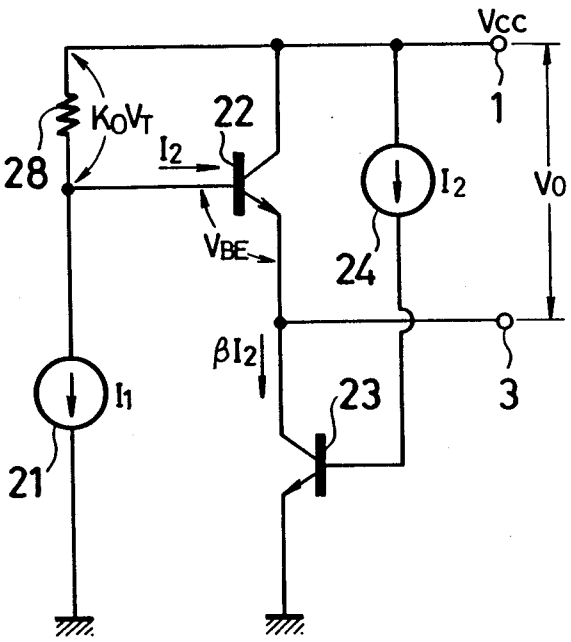
FIG. 4 is a connection diagram showing a fundamental arrangement of another embodiment of the voltage regulator circuit according to the present invention.

Another embodiment of the voltage regulator circuit according to the present invention will be described next with reference to FIGS. 4 and 5. FIG. 4 illustrates a fundamental arrangement of this embodiment, and in FIG. 4, like parts corresponding to those of FIG. 2 are marked with the same reference numerals and therefore need not be described in detail.

Referring to FIG. 4, one end of the current source 21 is connected to the base of the NPN transistor 22 and the other end of the current source 21 is grounded. The emitter of the transistor 22 and the collector of the second NPN transistor 23 are connected to each other, while the base of the transistor 23 and one end of the second current source 24 are connected to each other. Also, the collector of the transistor 22 and the other end of the second current source 24 are both connected to the voltage source terminal 1 (Vcc), and the emitter of the transistor 23 is grounded. An output terminal 3 is led out from the junction between the emitter of the transistor 22 and the collector of the transistor 23. By way of the resistor 28, the voltage source terminal 1 is commonly connected to the current source 21 and the base of the transistor 22.

In accordance with the embodiment shown in FIG. 4, similarly to the embodiment shown in FIG. 2, an output voltage $V_0$ equal to the aforesaid energy-gap voltage $V_{REF}$ and of which the fluctuation is small can be produced between the voltage source terminal 1 and the output terminal 3.

Figure 5:
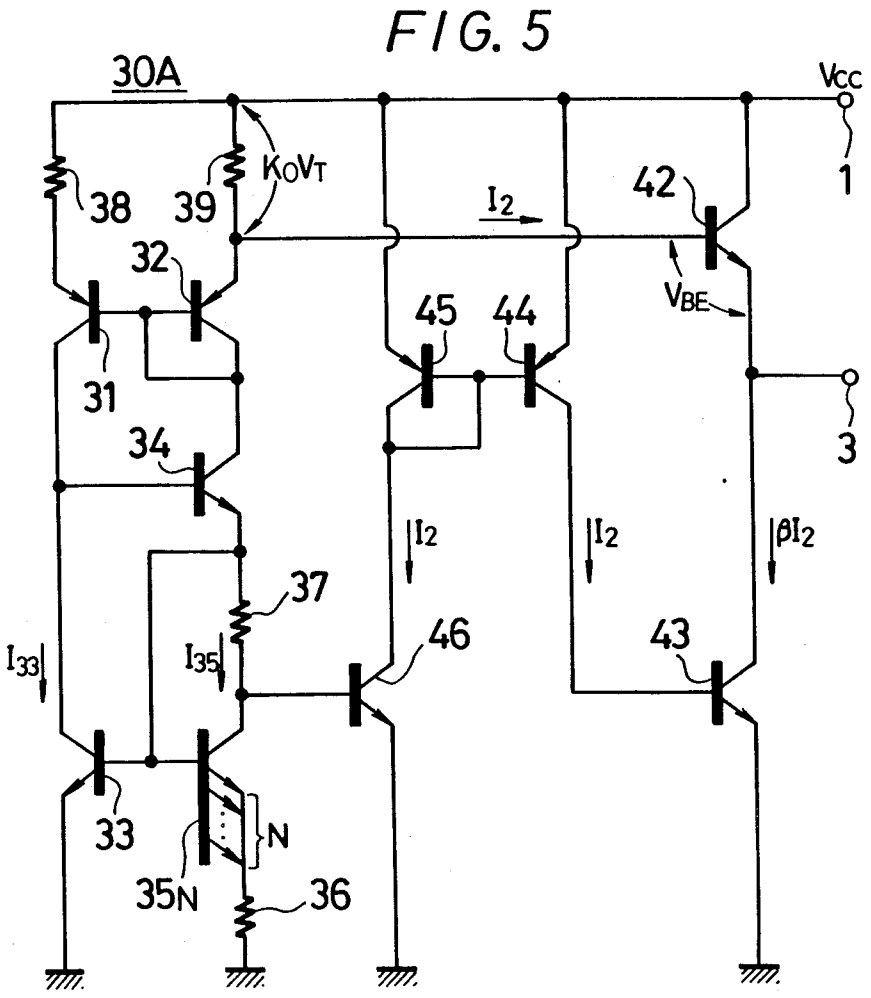
FIG. 5 is a connection diagram showing a practical arrangement of the embodiment of the present invention shown in FIG. 4.

FIG. 5 illustrates a practical arrangement of the embodiment shown in FIG. 4. In FIG. 5, like parts corresponding to those of FIG. 3 are marked with the same reference numerals and an overlapping explanation therefor will be omitted partly.

In FIG. 5, reference numeral 30A generally designates a constant current circuit in which respective emitters of a pair of PNP transistors 31 and 32 of current mirror circuit configuration are connected through resistors 38 and 39 to the voltage source terminal 1. The junction between the resistor 39 and the emitter of the transistor 32 is connected with the base of the transistor 42 and the output terminal 3 is led out from the junction between the emitter of the transistor 42 and a collector of a transistor 43. The collector of the transistor 42 is connected to the voltage source terminal 1 and the emitter of the transistor 43 is grounded.

Collectors of a pair of PNP transistors 44 and 45 of current mirror circuit configuration are respectively connected to the base of the transistor 43 and a collector of a transistor 46 of which the emitter is grounded. The base of the transistor 46 whose emitter is grounded is connected to the collector of the multi-emitter transistor $35_N$.

In the embodiment shown in FIG. 5, the current flowing to the resistor 39 is a sum of the base current $I_2$ of the transistor 42 which is connected in series to the transistor 43 and through which flows the collector current $\beta I_2$ and the collector current $I_{35}$ (expressed by the equation (10)) of the multi-emitter transistor $35_N$. As earlier described in connection with embodiment shown in FIG. 3, the collector current $I_{35}$ of this transistor $35_N$ is equal to the collector current $I_1$ of the transistor 41 provided as the current source.

Thus, in the embodiment shown in FIG. 5, the voltage across the resistor 39 is equal to the voltage across the resistor 48 of the embodiment shown in FIG. 3 and is presented as $K_0 V_T$.

According to the present invention, as set forth above, since the constant current source, through which the current flows, is $\beta$ times as large as the reference current flow, and is connected to the collector-emitter current path of the transistor in series, it is possible to obtain a voltage regulator circuit which can suppress the base-emitter voltage of the transistor from fluctuation due to the fluctuation of the base impurity concentration in the manufacturing process.

The above description is given on the preferred embodiments of the invention and it will be apparent that many modifications and variations thereof could be effected by one with ordinary skill in the art without departing from the spirit and scope of the novel concepts of the invention so that the scope of the invention should be determined only by the appended claims.

I claim as my invention:

1. A voltage regulator circuit comprising:

(a) a first current source for generating a predetermined current;

(b) a first transistor supplied at its base with the predetermined current from said first current source and for generating an emitter current which is $\beta$ times as large as said predetermined current;

(c) a second transistor having a collector connected with said emitter of said first transistor and of which the emitter is grounded;

(d) a second current source connected at its one end to the base of said second transistor and one end of a resistor which generates a reference voltage; and (e) a buffer amplifier connected between the emitter of said first transistor and the other end of said resistor, wherein a predetermined voltage is derived at the other end of said resistor.

2. A voltage regulator circuit according to claim 1, wherein said second current source is supplied with a bias voltage from a current mirror circuit.

3. A voltage regulator circuit according to claim 2, wherein said current mirror circuit includes:

first and second transistors of a first conductivity type of which the emitters are connected together to a first reference potential and of which the bases are connected to each other;

a third transistor of a second conductivity type of which the collector is connected to the collector and base of said second transistor and of which the base is connected to the collector of said first transistor;

an emitter-grounded fourth transistor of the second conductivity type of which the collector is connected to the base of said third transistor and of which the base is connected to the emitter of said third transistor and a fifth transistor of the second conductivity type having a base connected to the base of said fourth transistor; and a collector connected through a resistor to the emitter of said third transistor and an emitter connected through a resistor to a second reference potential, wherein the bias voltage is derived from a selected terminal of said fourth transistor.

4. A voltage regulator circuit according to claim 3, wherein an emitter area of said fifth transistor in said current mirror circuit is selected to be an integral multiple of that of said fourth transistor.

5. The voltage regulator circuit according to claim 3, wherein the selected terminal of said fourth transistor is the base terminal.

6. The voltage regulator circuit according to claim 3, wherein the selected terminal of said fourth transistor is the collector terminal.

7. A voltage regulator circuit comprising:

first and second terminal means for establishing first and second reference voltages, respectively, and third terminal means for supplying an output voltage;

a pair of transistors of like conductivity type connected in series between said first and second terminal means, one of said transistors having a collector connected to one of said first and second terminal means, the other of said transistors having an emitter connected to the other of said first and second terminal means, and an emitter of one of said transistors being connected to a collector of the other of said transistors;

a pair of current source means respectively connected to bases of said transistors and to different ones of said first and second terminal means; and resistor means connected between the base of one of said transistors and one of said terminal means;

whereby fluctuations of the base-emitter voltage of said transistors because of scattering of a base impurity in said transistors is suppressed and said output terminal produces a voltage that is maintained constant.

8. A voltage regulator circuit comprising:

(a) a first current source for generating a predetermined current;

(b) an emitter-grounded first transistor supplied at its base with the predetermined current from said first current source;

(c) a second transistor having a collector connected to a first reference potential, a base connected through a resistor to said first reference potential and an emitter connected to the collector of said first transistor and a voltage output terminal; and (d) a second current source connected between the base of said second transistor and a second reference potential.

9. A constant current circuit comprising:

(a) a first transistor of a first conductivity type having an emitter connected through a first resistor to a first reference potential;

(b) a second transistor of the first conductivity type having a base and a collector connected to the base of said first transistor and an emitter connected through a second resistor to said first reference potential;

(c) a third transistor of a second conductivity type having a base connected to the collector of said first transistor and a collector of a fourth transistor of a second conductivity type of which the emitter is grounded, a collector connected to the base and collector of said second transistor and an emitter connected to a base of said fourth transistor; and (d) a fifth transistor of a second conductivity type having a base connected to the base of said fourth transistor and the emitter of said third transistor, a collector connected through a third resistor to the emitter of said third transistor and an emitter connected through a fourth resistor to a second reference potential, wherein an output voltage is derived from the emitter of said second transistor and/or the collector of said fifth transistor.

10. A constant current circuit according to claim 9, wherein an emitter area of said fifth transistor is selected to be an integral multiple of an emitter area of said fourth transistor.

* * * * *